United States Patent [19]

Stoll et al.

[11] 4,176,586

[45] Dec. 4, 1979

[54] PISTON AND CYLINDER DEVICE

[76] Inventors: Kurt Stoll, Lenzhalde 72, Esslingen; Manfred Rüdle, Thomasächkerweg 17, Esslingen-Berkheim, both of Fed. Rep. of Germany

[21] Appl. No.: 819,858

[22] Filed: Jul. 28, 1977

Related U.S. Application Data

[63] Continuation of Ser. No. 654,044, Jan. 30, 1976, abandoned.

[30] Foreign Application Priority Data

Jan. 31, 1975 [DE] Fed. Rep. of Germany ..... 7502826

[51] Int. Cl.[2] ..... F01L 25/08; F01L 31/00; F01B 31/12

[52] U.S. Cl. ..... 92/5 R; 91/275; 91/277; 91/DIG. 4

[58] Field of Search ..... 91/275, 277, 306, DIG. 4; 335/153; 92/5 R

[56] References Cited

U.S. PATENT DOCUMENTS

| | | | |
|---|---|---|---|
| 2,462,571 | 2/1949 | Thompson et al. | 91/275 |
| 2,755,966 | 7/1956 | Lindars | 91/275 |
| 3,364,361 | 1/1968 | Burger | 91/275 |

*Primary Examiner*—Paul E. Maslousky
*Attorney, Agent, or Firm*—Watson, Cole, Grindle & Watson

[57] ABSTRACT

A piston and cylinder device with a piston mounted for reciprocating movement in the cylinder has on the outside of the cylinder an elongated mounting element comprising two guiding members on each of which a limit switch is mounted for positioning longitudinally of the cylinder. The limit switch is formed with a switch blade of ferromagnetic material and the piston has an annular rim constituted of permanent magnetic material. The switches can be adjusted longitudinally for the purpose of adjusting the stroke of the piston.

4 Claims, 5 Drawing Figures

PISTON AND CYLINDER DEVICE

BACKGROUND OF THE INVENTION

This is a continuation, of application Ser. No. 654,044 filed Jan. 30, 1976 now abandoned.

The invention relates to piston and cylinder devices and especially, but not exclusively, to pneumatic piston and cylinder devices which incorporate a reciprocating piston and an elongated mounting element extending over at least part of the length of the cylinder at one side thereof and supporting limit-switches which are actuated when the piston moves past them and reverse the piston movement by controlling the working medium admitted into the cylinder.

THE PRIOR ART

One form of commercially available cylinder of this type has two limit switches which, in relation to the longitudinal direction of the cylinder, are mounted on the mounting element in tandem fashion. Since the space taken up by the limit switches in the axial direction of the cylinder varies depending on the switch design, the minimum piston stroke is determined by the dimensions of the limit-switches. Because of this, the smallest attainable piston stroke is never below several centimeters, which is far too much for many applications. Although it is theoretically feasible to arrange the two limit-switches at the two opposite sides of the cylinder, in many cases the required space is not available. It is also better for reasons of maintenance to arrange both the limit-switches on one side of the cylider. It is an object of the present invention to obviate or mitigate this difficulty.

SUMMARY OF THE INVENTION

According to the invention the two limit-switches are arranged on the mounting element in angularly displaced positions relative to the axis of the cylinder.

With this arrangement it is possible for the minimum piston stroke to be reduced to a few millimeters since the only factor on which it depends is the hysteresis of the limit-switches used with the system. Moreover, the overall dimensions of the cylinder are still small and economical in respect of space requirements because the limit-switches are located close together.

Although it would be feasible to design a cylinder whose mounting element consists of two bars, the element used preferably comprises only one sectioned rail which extends parallel to the direction of the reciprocating movements of the piston, this form being preferred because it simplifies the assembly of parts during manufacture and provides for a parallel arrangement of the two limit-switches. The design of the cylinder is particularly simple, and the manufacturing cost correspondingly less, when the sectioned rail comprises at least two parallel grooves and/or projections in or on to which the two limit-switches are positioned and fixed. Preferably, also, the grooves or projections of the sectioned rail extend essentially in a V-shaped fashion including between them an angle, for example, between 60° and 120°, and preferably of 90°, as this enables the limit-switches to be mounted side by side at a particularly close and economical spacing, preferably in a manner which adapts the unit to the circumferential form of the cylinder.

The webs may terminate in a portion of increased cross-section which enables the cylinder to be used in a great many applications since the piston stroke is variable between the cylinder length and a few millimeters, which means that the same type of cylinder can be used in a wide field of applications. In addition, this facilitates and simplifies stock-keeping. It is advantageous for the mounting element to extend essentially over the entire length of the cylinder body and for the limit-switches to be adjustable on the mounting element as regards their relative positions which determine the piston stroke, and in which they can be fixed, since this enables the limit-switches to be adjusted in a simple and quick manner. A clamping device could, for example, be provided having a screw-system enabling adjustment of the frictional contact between the limit-switch and the mounting rail. Alternatively, the device could include a clamping unit with a constant retaining force, in which case the system could be adjusted with the aid of an external load which has to overcome this retaining force.

In order to lower the sensitivity of the limit-switches to impacts, vibration, and the like and thereby to increase their reliability in operation as much as possible, the sectioned bar could be screwed to the outer wall of the cylinder. With this arrangement, a permanent magnet could be provided at a flexible blade of the limit switch and the piston could be made of a ferromagnetic material or vice-versa, the latter version being more expedient because of the inevitable size and weight of the permanent magnet which would have practically no effect on the dimensions and weight of the piston but would have considerable effect at the flexible switch blade.

BRIEF DESCRIPTION OF THE DRAWINGS

Embodiments of the invention will now be described, by way of example only, with reference to the accompanying drawings, in which.

DESCRIPTION OF THE PREFERRED EMBODIMENTS

Figure 1:
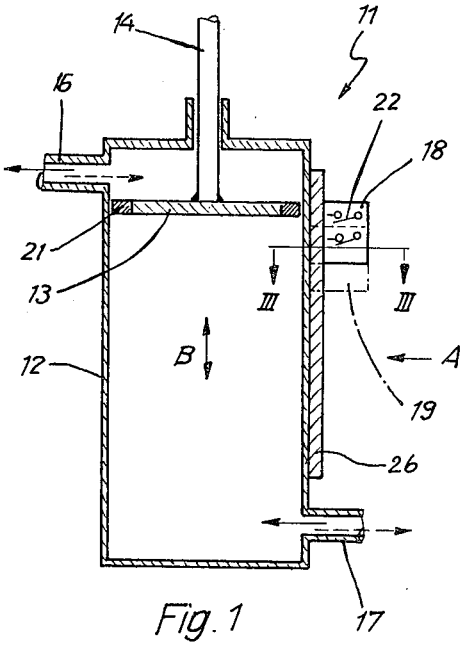
FIG. 1 shows a piston and cylinder device according to the invention partly in longitudinal section and partly in schematic, each of the limit switches being schematically shown on a mounting element.

The device 11 shown in FIG. 1 comprises a cylinder 12 which contains an axially displaceable piston 13 having a piston rod 14. The device is pneumatically driven and has upper and lower connections (e.g., first and second conduit means) 16, 17, through which the working medium—in the illustrated system it is compressed air—is admitted and discharged so that the piston 13 may perform reciprocating movements in the directions of the double-headed arrow B. The piston movement of this double-acting cylinder is reversed in a known manner by means of pneumatic valves which are not shown in the drawings and which are controlled by two limit-switches 18, 19. These two limit switches 18, 19, which are located on the outside of the cylinder body in a manner described below, are activated through the wall of the cylinder when the piston 13 moves past their position, the piston 13 being provided with an annular permanent magnet 21 which, when the piston 13 moves past the limit switches 18, 19 causes switch blade 22 made of a ferromagnetic material in the limit switches 18, 19 to open or close a pneumatic or electric control circuit which is not shown in the drawings and which connects with the above-mentioned control valves. In the illustrated embodiment, the flexible switch blade 22 opens the corresponding circuit when the annular magnet 21 on the piston 13 travels past the respective limit-switch 18 or 19 and closes it under the effect of its own spring load when the piston 13 moves away from it. The limit-switches 18, 19 could instead operate in reverse, in which case the flexible switch blade 22 closes the associated control circuit when influenced by the annular magnet 21. Moreover the limit switches could be of different design; the important factor it that they are contactless type limit-switches.

In the working position shown in FIG. 1 the piston is depicted at the moment when it has completed its upward stroke, the working medium being admitted into and discharged from the cylinder 12 as indicated by the continuous-line arrows. In this upper position, the annular magnet 21 on the piston 13 has opened the flexible blade 22 of the limit-switch 18, thus causing the control valves to reverse, so that the working medium is admitted into and discharged from the cylinder in accordance with the broken-line arrows. The piston 13 and piston rod 14 therefore move in a downward direction until the annular magnet 21 reaches the level of the limit-switch 19 whose flexible blade 22 is still in the closed position.

Figure 3:
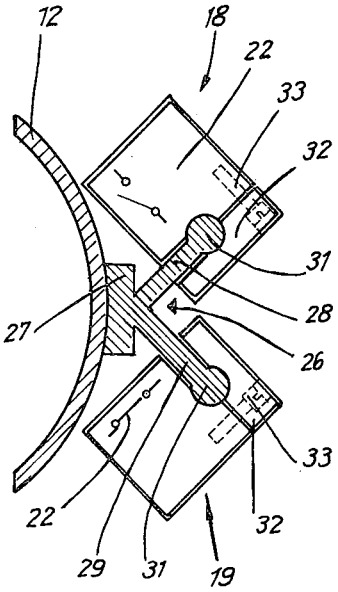
FIG. 3 shows a section along the line III—III in FIG. 1 to an enlarged scale.
Figure 2:
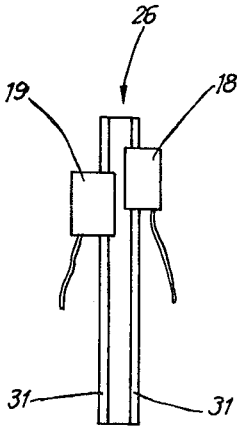
FIG. 2 shows part of the mounting element with the two limit switches, viewed in the direction of the arrow A in FIG. 1.

As best seen in FIGS. 2 and 3, the two limit-switches 18, 19 are adjustably supported on a mounting element in the form of a sectioned rail extending along the outer circumference of the cylinder body 12 parallel to the longitudinal axis of the cylinder and consequently also parallel with the direction in which the piston 13 moves. The base 27 of the sectioned rail 26 may be fixed to the cylinder body 12 in any suitable manner, for example, by means of screws or bolts or by gluing. Like the cylinder body 12, the sectioned rail 26 consists of a non-ferromagnetic material, for example, aluminum, brass, a plastics material or the like. The base 27 is provided with two integrally mounted webs 28, 29 which project essentially in a V-shaped fashion in relation to one another, and terminate at their free ends in two integral beads 31 of enlarged cross-section. Each limit switch 18, 19 is provided at one end with a clamping element 32, the adjacent surfaces of each limit switch and of the associated clamping element being shaped to correspond to the form of the webs 28, 29, so that the limit switches 18, 19 can be fixed to the webs 28, 29 of the rail 26, for example, by means of screws. The frictional connection between the limit-switches 18, 19 and the rail 26 is adjustable by the aid of a screw 33, shown in broken lines, so that the limit-switches can be adjusted along the rail 26 and fixed to the latter in any given position and at any relative spacing.

Since the rail 26 extends over almost the entire length of the cylinder 12, the maximum distance between the two limit switches 18, 19, and hence also the maximum piston stroke, are determined by the length of the cylinder or rather the length of the sectioned rail 26. As shown especially in FIG. 2, the two limit-switches 19, 18 are supported on the sectioned rail 26 in such a manner that they are angularly displaced about the cylinder with their adjacent side edges extending parallel to each other and slightly spaced apart. In this way it is possible, as shown in FIG. 2, to arrange the two limit switches 18, 19 side by side on the rail 26 and it is therefore possible to reduce the minimum piston stroke to a few millimeters, since this minimum piston stroke depends essentially on the hysteresis of the limit-switches 18, 19 alone. Thus, by virtue of the disposition of the rail 26, the webs 28, 29 and the limit-switches 18, 19, can be arranged side by side without increasing the space requirements.

In the embodiment described above the sectioned rail is provided with webs which are surrounded by the limit-switches. Alternatively, the sectioned rail could be provided with undercut grooves which engage with correspondingly shaped webs on the limit switches. In a further modification, the webs could be replaced by circular rods extending parallel to each other and fixed directly and independently to the cylinder body so that they extend side by side with a small spacing between them.

Figure 5:
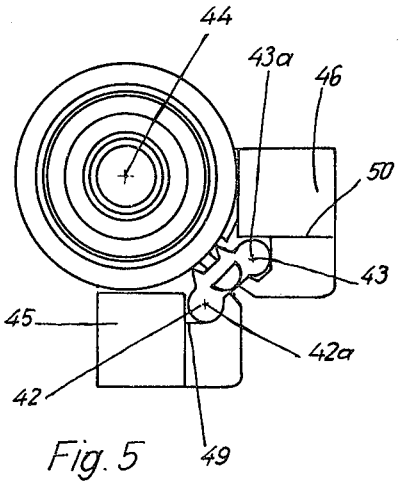
FIGS. 4 and 5 show a variant of the embodiment according to FIGS. 1 and 3, in side and front elevation respectively.
Figure 4:
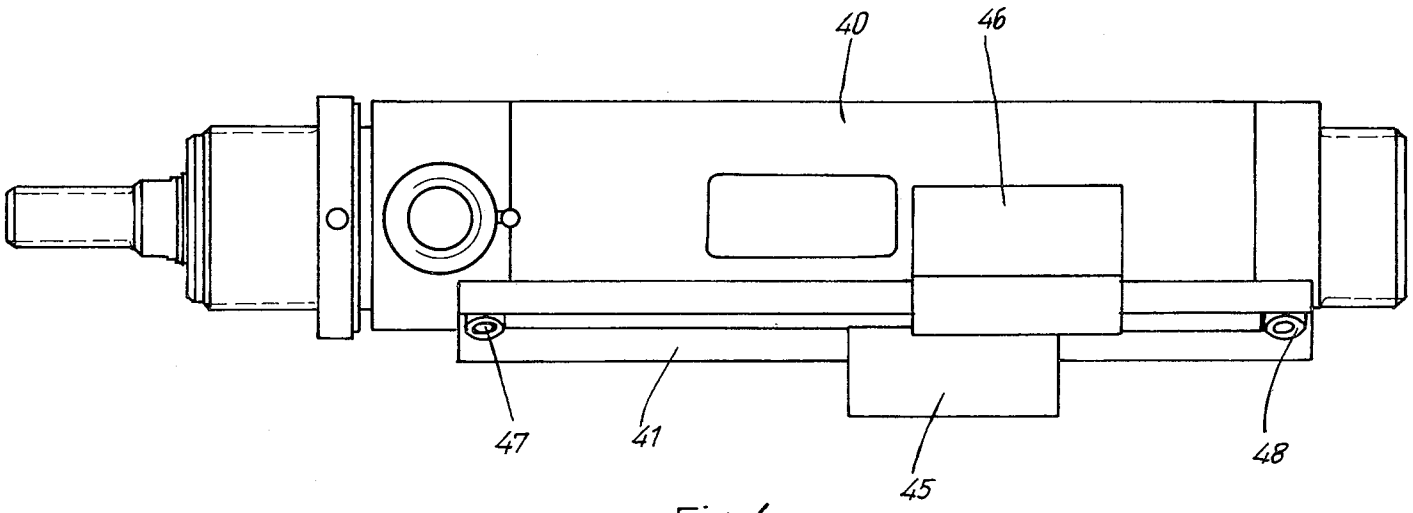

FIGS. 4 and 5 show a variant of the arrangement according to FIGS. 1 to 3, in which a modified form of mounting rail is utilized. The rail 41, which extends over almost the entire length of the cylinder 40, is mounted at its ends at 47, 48, and is provided with two web-like projections 42, 43, forming connecting rails having an acute angle of say, 30°–60° between their respective centres **42*a*, 43*a*, and the longitudinal median axis 44 of the cylinder. The limit-switches 45, 46 are pushed on to the web-like projections 42, 43 such that grooves 49, 50** in the switches engage with cylindrical end portions of the projections.

Although our invention has been illustrated and described with reference to the preferred embodiments thereof, we wish to have it understood that it is in no way limited to the details of such embodiments, but is capable of numerous modifications within the scope of the appended claims.

Having thus fully disclosed our invention, what we claim is:

1. A piston and cylinder device comprising an elongated hollow enclosed cylinder having an exposed outer surface;

a piston positioned within said cylinder and capable of reciprocating movement along the elongation direction thereof based on working medium input into said cylinder;

an elongated mounting element positioned on the outer surface of said cylinder and extending parallel to the elongation direction thereof, said elongated mounting element including an elongated base and two elongated webs connected to said base and extending away therefrom in a V-shaped fashion along the elongation direction of said base;

two limit switches mounted on said mounting element, each being respectively mounted on one of said elongated webs so as to be independently movable along the elongation direction of said mounting element and thus said cylinder, each of said two limit switches being activated by movements of said piston past their positions and capable of controlling the admission of working medium into said cylinder and thus the movement of said piston therewithin.

2. The piston and cylinder device of claim 1 wherein said elongated mounting element includes a bead of enlarged cross-section, when compared to the cross-section of the webs, positioned at the ends of each of said two webs.

3. The piston and cylinder device of claim 1 wherein said elongated mounting element extends along substantially the entire length of the elongated cylinder.

4. The piston and cylinder device of claim 1 wherein said piston includes an annular magnet therein; wherein said limit switches are activated by the passage of the annular magnet in said piston therepast; and wherein the cylinder and the mounting element are composed of a non-ferromagnetic material.

* * * * *